US005161440A

United States Patent [19]

Jordan

[11] Patent Number: 5,161,440

[45] Date of Patent: Nov. 10, 1992

[54] WRENCH FOR TRANSMITTING VARIABLE MAGNITUDE VIBRATIONAL FORCES TO BOLT

[76] Inventor: Robert O. Jordan, 2219 N. Scottsdale Rd., Scottsdale, Ariz. 85257

[21] Appl. No.: 716,259

[22] Filed: Jun. 17, 1991

[51] Int. Cl.[5] ..... B25B 19/00

[52] U.S. Cl. ..... 81/463; 81/465

[58] Field of Search ..... 81/463, 465, 466

[56] References Cited

U.S. PATENT DOCUMENTS 3,831,468 8/1974 Miller ..... 81/466

4,819,523 4/1989 Souza ..... 81/465

4,979,574 12/1990 Lalama et al. ..... 81/463

OTHER PUBLICATIONS

"Buck Rogers, 2429 A.D."-Washington Post, Mar. 10, 1930, Nowlan and Calkins (wrench in second frame).

*Primary Examiner*—Bruce M. Kisliuk

*Assistant Examiner*—Lawrence Cruz

*Attorney, Agent, or Firm*—Tod R. Nissle

[57] ABSTRACT

A wrench for producing unbalanced vibrational forces which are transmitted to a bolt turned by the wrench. The wrench produces counteracting torque forces which act on the sides of the wrench handle to facilitate the production of unbalanced vibrational forces.

2 Claims, 2 Drawing Sheets

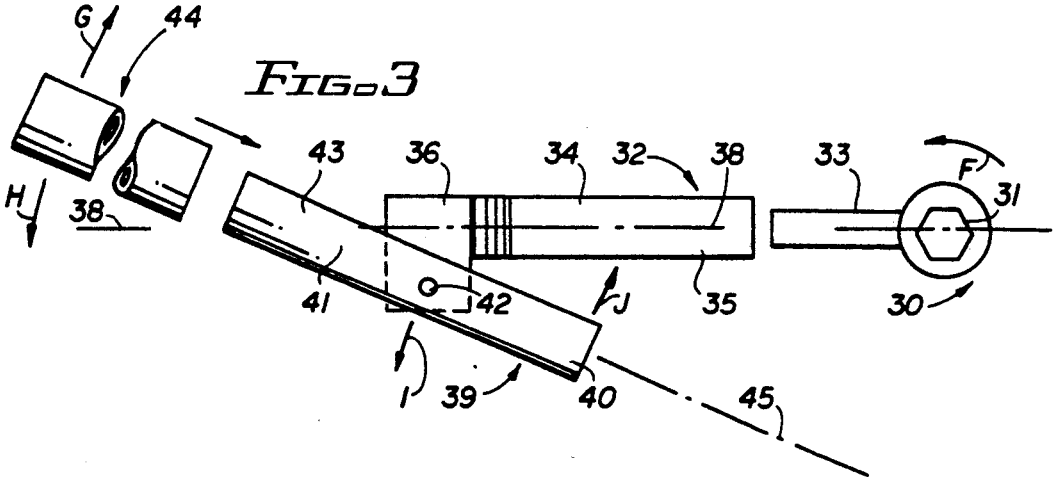
FIG. 3
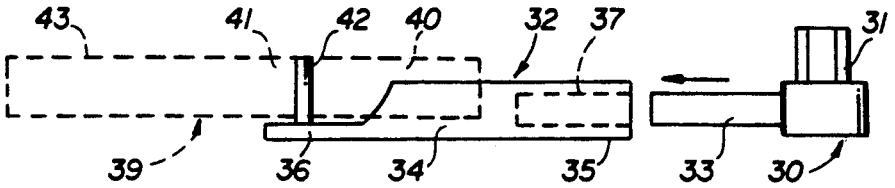
FIG. 4
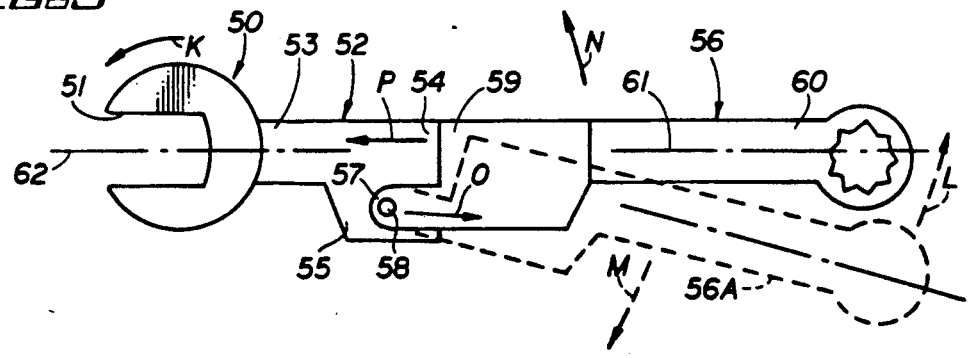
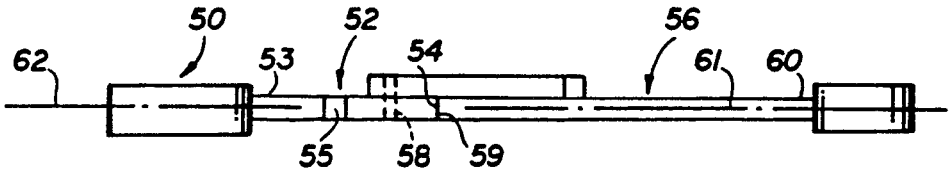
FIG. 6

WRENCH FOR TRANSMITTING VARIABLE MAGNITUDE VIBRATIONAL FORCES TO BOLT

This invention relates to a wrench.

More particularly, the invention relates to a wrench which generates and transmits to a bolt being turned by the wrench sound waves and vibrational energy which assist in loosening the bolt with respect to the threaded member which is receiving the bolt.

In a further respect, the invention relates to a wrench which in use produces counteracting torque forces that promote the transmission to a bolt of vibrational forces which have differing magnitude when the point on the bolt at which the vibrational forces are transmitted into the bolt is altered.

Applying sound waves or vibrational energy to a bolt while the bolt is being turned by a wrench is often desirable in tightening or loosening the bolt. The usefulness of such energy is demonstrated by the common practice of utilizing the handle of a knife to strike the lid of a jar when the lid is tightly turned onto the jar and the lid is therefore not readily manually removed from the jar. Striking the edge of the lid produces sound waves and vibrational energy which are transmitted through the lid and which function to loosen the grip of the lid on the threaded edge of the jar.

While the application of vibrational force to a bolt is desirable, the application of large magnitude forces along the handle of the wrench to loosen a bolt is not desirable because such large magnitude forces produce a torque along the length of the handle of the wrench which can bend the handle of the wrench.

Accordingly, it would be highly desirable to provide an improved wrench which would enable a user to produce and transmit sound waves and vibrational forces through the handle of the wrench to a bolt being turned by the wrench and which could use low magnitude counteracting torque forces to produce the sound waves and vibrational forces and to produce an additional cumulative torque force on the handle of the wrench which was negligible.

It would also be highly desirable to provide an improved wrench which would enable a user to produce and transmit sound waves and vibrational forces through the handle of the wrench and which would, when the sound waves and vibrational forces were produced, produced counteracting torque forces acting in directions generally parallel to the elongate axis of the handle of the wrench, such that said forces subjected the handle of the wrench to compression or tension instead of to a bending moment.

Therefore, it is a principal object of the invention to provide an improved wrench.

A further object of the invention is to provide an improved wrench which in use generates vibrational forces which are transmitted to a bolt turned by the wrench and which, in generating the vibrational forces, produces a minimal bending moment or torque on the handle of the wrench.

Another object of the instant invention is to provide an improved wrench which generates imbalanced vibrational forces by causing the forces to emanate from points offset from the longitudinal axis of the handle of the wrench.

These and other, further and more specific objects and advantages of the invention will be apparent to those skilled in the art from the following detailed description thereof, taken in conjunction with the drawings, in which:

FIG. 3 is a top view illustrating a wrench constructed in accordance with another embodiment of the invention;

FIG. 4 is a top view of the wrench of FIG. 3 illustrating further construction details thereof;

FIG. 5 is a top view illustrating a wrench constructed in accordance with still another embodiment of the invention; and, FIG. 6 is a front view illustrating the wrench of FIG. 5.

Figures 1, 2:
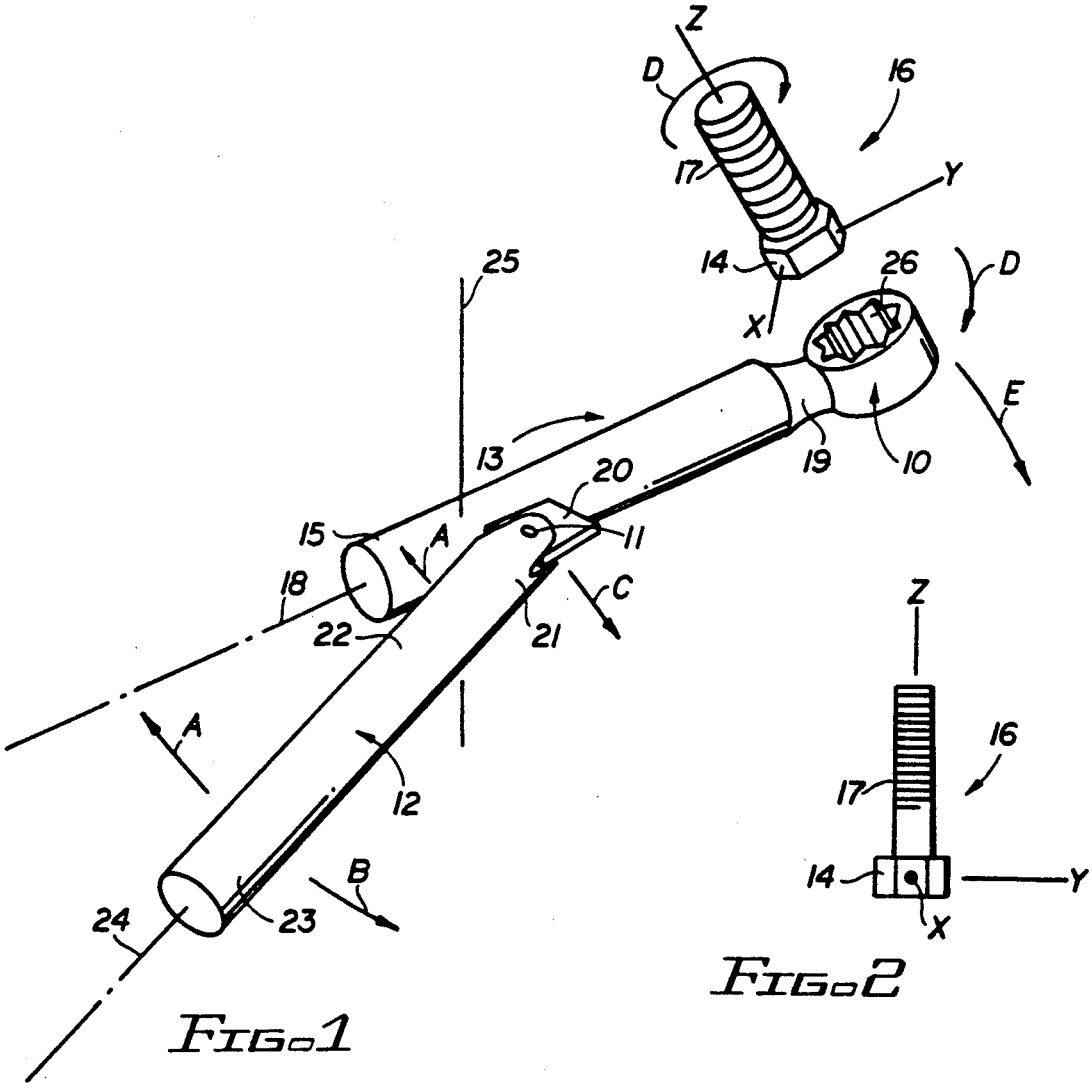
FIG. 1 is a perspective view illustrating a wrench constructed in accordance with the principles of the invention.
FIG. 2 is a front elevation view illustrating a bolt turned in an internally threaded aperture with the wrench of FIG. 1.

Briefly, in accordance with my invention, I provide a wrench including a first end shaped and dimensioned to engage the head of a bolt, said head lying in a first plane and said bolt having a screw thread with a longitudinal axis perpendicular to the first plane; an elongate arm attached to and outwardly extending from the first end and including a longitudinal axis at an angle to the first plane when the first end engages the head of the bolt, a proximate end attached to the first end, and a distal end spaced away from the proximate end; and, an elongate member including a primary end including a first section attached at a pivot point to the distal end of the arm and including a striking portion, a second end spaced away from the distal end and the primary end and extending beyond the distal end, and a longitudinal axis substantially parallel to the first plane. The striking portion of the elongate member contacts the distal end at a contact point to generate vibrations traveling through the arm when the second end is grasped, the elongate member is pivoted back toward the distal end, and the elongate member is then pivoted back toward the distal end. When the striking portion contacts the distal end, it generates first and second opposing counteracting torque forces generally lying in a common plane with the longitudinal axes of the arm and the elongate member. The first torque force acts at the pivot point of the primary end and the second torque force acts against the distal end of the arm. The longitudinal axis of the elongate member remains substantially parallel to the first plane during the pivoting of the elongate member away from and back toward the distal end. At least one of the pivot points and the contact point can be spaced apart from the longitudinal axis of the arm such that the vibrations emanate into the distal end from the pivot point and the contact point.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a wrench constructed in accordance with the invention and including a first end shaped and dimensioned to engage the hexagonally shaped head 14 of a bolt 16. Head 14 generally lies in a plane which passes through axes X and Y. Bolt 16 includes a longitudinal axis which is colinear with axis Z and perpendicular to axes X and Y and to the plane passing through axes X and Y. The longitudinal axis of bolt 16 comprises the centerline of cylindrically shaped screw thread 17. The relationship of axes X, Y and Z is further illustrated in FIG. 2. Elongate cylindrical arm 13 is attached to and outwardly extends from end 10 and includes longitudinal axis 18 which is, when end 10 is slipped over and engages head 14, at about a ninety degree angle to the longitudinal axis Z of bolt 16 and is substantially parallel to the plane passing through axes X and Y. The proximate end 19 of arm 13 is attached to end 10. The distal end 15 of arm 13 is spaced away from proximate end 19. Flange 20 is attached to and outwardly extends from arm 13. Elongate member 12 includes a primary end. The primary end of member 12 includes a first section 21 pivotally attached to flange 20 by pin 11 and includes striking portion 22. The second end 23 of member 12 is spaced away from distal end 15 and from the primary end of member 12. End 23 extends beyond distal end 15. The longitudinal axis or centerline 24 of member 12 is substantially parallel to the plane passing through axes X and Y when end 10 is slipped over and engages head 14 to rotate bolt 16.

In use of the wrench of FIG. 1, it is, for sake of example, assumed that end 10 has been slid over head 14 and that it is desired to turn bolt 16, head 14, and end 10 in the direction indicated by arrows D. End 23 is manually grasped and, if necessary, pivoted away from axis 18 in the direction of arrow B to separate striking portion 22 from end 15. When end 23 is moved in the direction of arrow B (or arrow A), first section 21 pivots about pin 11. After end 23 is moved a selected distance in the direction of arrow B, the direction of movement of end 23 is reversed and end 23 is manually pushed or pulled in the direction of arrow A until striking portion 22 contacts distal end 15. When striking portion 22 "slaps" or contacts distal end 15, vibrations and sound waves are produced which travel along arm 13 to end 10 and are transmitted to the head 14 engaged by end 10. Further, when portion 22 contacts distal end 15 a torque force is generated by section 21 against pin 11 in the direction of arrow C. This torque force acting in the direction of arrow C counteracts the torque force which is generated in the direction of arrow A when striking portion 22 contacts distal end 15. The greater the force with which portion 22 strikes distal end 15, the greater the counteracting torque force acting in the direction of arrow C. The torque force acting in the direction of arrow C acts away from the desired direction of travel of member 12, arm 13, end 10, and head 14. Pin 11 and flange 20 resist torque force C and prevent section 21 from actually moving off of flange 20 in the direction of arrow C.

If after striking portion 22 contacts distal end 15, the user continues to pull on end 23 in the direction of arrow A a torque force is generated on the wrench which acts along the length of member 12 and arm 13. But, at the instant portion 22 strikes end 15 and generates a torque force acting in the direction of arrow A, section 22 generates against pin 11 the torque force acting in the direction of arrow C. The counteracting torque forces acting in the direction of arrows A and C act in concert to attempt to rotate end 10 in the direction of arrow E and to rotate arm 13 and member 12 about axis 25. The engagement of head 14 with end 10 prevents, of course, any such rotation of arm 13 and member 12 about axis 25. Axis 25 generally is intermediate pin 11 and the point of contact between portion 22 and end 15 which is furthest from pin 11. When the counteracting torque forces acting in the directions of arrows A and C attempt to rotate end 10 in the direction of arrow E about axis 25, one portion of the inner toothed circular surface 26 of end 10 is pressed against head 14 in the direction of arrow E. This pressure of a portion of the surface 26 against head 14 is desirable because it, along with the offset position of pin 11 with respect to axis 18 and along with the contact of section 22 and end 15 at points offset from axis 18, tends to cause vibrational forces to be transmitted from end 10 to head 14 in varying intensities at various points on the periphery of head 14 which are in contact with surface 26. This uneven or unbalanced distribution of vibrational forces is believed desirable because if vibrational forces of equal magnitude are simultaneously transmitted into head 14 at points all around the periphery of head 14 the vibrational forces and/or sound waves intersect and interfere with one another. If, on the other hand, vibrational forces or sound waves are transmitted into head 14 at only one point, the forces tend to propagate completely through and across head 14 without interference from other incoming vibrations or sound waves. Striking portion 22 and pin 11 contribute to the imbalance of vibrational forces traveling along arm 13 because both portion 22 and pin 11 transmit vibrational forces into arm 13 from points offset from and to one side of axis 18.

The metal wrench of FIGS. 3 and 4 includes a first end 30 provided with outwardly depending hex nub 31. Nub 31 is shaped and dimensioned to engage a hex aperture or socket formed in the head of an Allen bolt or screw. Arm 32 includes cylindrical proximate end 33 fixedly attached to head 30 and includes hollow cylindrical sleeve 35 having distal end 34. Flange member 36 is connected to distal end 34. Aperture 37 of sleeve 35 is connected to distal end 34. Aperture 37 of sleeve 35 is shaped and dimensioned to slidably receive proximate end 33. Longitudinal axis or centerline 38 extends through sleeve 35 and end 33. Elongate member 39 includes a primary end which includes a striking portion 40 and a first section 41 pivotally attached to flange member 36 by pin 42. The second end 43 of member 39 is spaced away from distal end 34 and from the primary end of member 39. The second distal end 43 extends beyond distal end 34. If desired, an elongate hollow cylindrical sleeve 44 can be slid onto end 43 to extend and lengthen end 43. Longitudinal axis or centerline 45 extends through member 39 and sleeve 44.

In use of the wrench of FIGS. 3 and 4, it is, for sake of example, assumed that nub is inserted in the hex socket of an Allen bolt (not shown), and that it is desired to turn the Allen bolt, head 30 and nub 31 in the direction of arrow F. End 43 (or sleeve 44) is manually grasped and, if necessary, pivoted away from axis 38 in the direction of arrow G to separate striking portion 40 from distal end 34. When end 43 is moved in the direction of arrow G (or arrow H), first section 41 pivots about pin 42. After end 43 is moved a selected distance in the direction of arrow G, the direction of movement of end 43 is reversed and end 43 is manually pushed or pulled in the direction of arrow H until striking portion 40 contacts distal end 34. When striking portion 40 contacts distal end 34, vibrations and sound waves are produced which travel along arm 32 to end 30 and are transmitted to the hex of the Allen bolt engaged by nub 31. Further, when portion 40 contacts distal end 34, a torque force is generated by section 41 against pin 42 in the direction of arrow I. This torque force acting in the direction of arrow I counteracts the torque force which is generated in the direction of arrow J when striking portion 40 contacts distal end 34.

The wrench of FIGS. 5 and 6 includes a first end 50 provided with mouth 51 for sliding around and engaging the head 14 of a bolt (not shown in FIG. 5). Arm 52 includes proximate end 53 fixedly attached to head 50 and includes distal end 54. Flange member 55 is connected to distal end 54. The distal end 54 of arm 52 is spaced away from proximate end 53. Elongate member 56 includes a primary end. The primary end of member 56 includes striking portion 59 and includes a first section 57 pivotally attached to flange 55 by pin 58. The second end 60 of member 56 is spaced away from distal end 54 and from the primary end of member 56. End 60 extends beyond distal end 54. The longitudinal axis or centerline of member 56 is substantially parallel to the plane passing through axes X and Y of a bolt 16 when mouth 62 is slipped over and engages the head 14 of the bolt 16 in a conventional manner In use of the wrench of FIGS. 5 and 6, it is, for sake of example, assumed that end 50 is slid over head 14 of a bolt 16 and that it is desired to turn bolt 16, head 14, and end 50 in the direction indicated by arrow K in FIG. 5. If bolt 16 were drawn in FIG. 5, the longitudinal axis Z of the screw thread 17 of bolt 16 would be perpendicular to the plane of the sheet of paper of the drawings. Member 56 is manually grasped and pivoted away from distal end 54 in the direction of arrow M to separate striking portion 59 from end 54. When member 56 is moved in the direction of arrow M (or L), first section 57 pivots about pin 58. After member 56 is moved to the position indicated by dashed lines 56A, the direction of movement of member 56 is reversed and member 56 is manually pushed or pulled in the direction of arrow L until striking portion 59 contacts distal end 54. When striking portion 59 "slaps" and contacts distal end 54, vibrations and sound waves are produced which travel along arm 52 to end 50 and are transmitted to the head 14 engaged by mouth 51. Further, when portion 59 contacts distal end 54 a torque force is generated by section 57 against pin 58 in the direction of arrow O. This torque force acting in the direction of arrow O counteracts the torque force which is generated in the direction of arrow P when striking portion 59 contacts distal end 54. Since the torque force acting in the direction of arrows O and P are generally parallel to colinear axes 61 and 62 in FIG. 5, the cumulative torque force or bending moment which acts in the direction indicated by arrow N and is caused by the torque forces acting in the direction of arrows O and P is minimal. The embodiment of the invention shown in FIGS. 5 and 6 therefore minimizes the magnitude of torque forces which are generated by the vibration inducing apparatus of the invention and which are transverse or at an angle to the longitudinal axes 61, 62 of the wrench. If desired, pin 58 can be attached to arm 52 at a point along axis 62 and section 57 can be shaped to pivot about pin 58 such that striking portion 59 can contact distal end 54 when member 56 is moved in the direction of arrow N. Offsetting pin 58 with respect to axis 62 is, however, presently preferred. Similarly, in FIG. 1 pin 11 can be positioned along axis 18 and section 21 can be shaped to pivot about pin 11 such that striking portion 22 can contact distal end 15 when member 12 is moved in the direction of arrow A.

Having described my invention in such terms as to enable those skilled in the art to understand and practice it, and having identified the presently preferred embodiments thereof, I claim:

1. A wrench including (a) a first end shaped and dimensioned to engage the head of a bolt, said head lying in a first plane and said bolt having a screw thread with a longitudinal axis perpendicular to said first plane;

(b) an elongate arm attached to and outwardly extending from said first end and including (i) a longitudinal axis at an angle to the longitudinal axis of said bolt and substantially parallel to said first plane when said first end engages said head of said nut, (ii) a proximate end attached to said first end, and (iii) a distal end spaced away from said proximate end;

(c) an elongate member including (i) a primary end including a first section attached at a pivot point to said distal end of said arm, and, a striking portion, (ii) a second end spaced away from said distal end and said primary end and extending beyond said distal end, and (iii) a longitudinal axis substantially parallel to said first plane;

said striking portion (d) contacting said distal end at at least one contact point to generate vibrations traveling through said arm when said (i) said end is grasped, (ii) elongate member is pivoted away from said distal end, and (iii) elongate member is pivoted back toward said distal end; and, (e) on contacting said distal end, generating opposing counteracting first and second torque forces generally lying in a common plane with said longitudinal axes of said arm and said elongate member, said first torque force acting at said pivot point of said primary end and said second torque force acting against said distal end of said arm;

said longitudinal axis of said elongate member remaining substantially parallel to said first plane during said pivoting of said elongate member away from and back toward said distal end.

2. The wrench of claim 1 wherein at least one of said pivot point and contact point are spaced apart from said longitudinal axis of said arm and said vibrations emanate into said distal end from said pivot point and said contact point.

* * * * *